United States Patent [19]

Loechner

[11] Patent Number: 4,923,174

[45] Date of Patent: May 8, 1990

[54] APPARATUS FOR BI-DIRECTIONALLY MOVING AND PLACING LARGE AND HEAVY OBJECTS

[75] Inventor: Steven R. Loechner, Roanoke, Ind.

[73] Assignee: G & L Corporation, Fort Wayne, Ind.

[21] Appl. No.: 306,482

[22] Filed: Feb. 3, 1989

[51] Int. Cl.[5] ..... B66F 1/04; B66F 3/24

[52] U.S. Cl. ..... 254/105; 254/111

[58] Field of Search ..... 414/749, 750, 14, 17; 254/105, 109, 110, 111, 93 R

[56] References Cited

U.S. PATENT DOCUMENTS

| | | | |
|---|---|---|---|
| 3,031,167 | 4/1962 | Roussel | 254/105 |
| 3,140,076 | 7/1964 | Steadman | 254/105 |
| 3,510,012 | 5/1970 | Van Meteren | 254/105 |
| 3,659,823 | 5/1972 | Griffin | 254/93 R |
| 4,066,110 | 1/1978 | Sarno | 144/193 A |
| 4,212,450 | 7/1980 | Lambert | 254/105 |
| 4,311,429 | 1/1982 | Wallis | 414/750 |

*Primary Examiner*—David H. Brown

*Attorney, Agent, or Firm*—Jeffers, Hoffman & Niewyk

[57] ABSTRACT

An improved portable apparatus for moving and precisely placing a large and heavy object includes load support rails, aligned pairs of anchoring structures secured to and spaced longitudinally from one another along the rails, an actuator-supporting shoe movable along the support rails having lugs for releasably engaging one pair of the anchoring structures to hold the shoe in a stationary position, and an actuator extending between and connecting the shoe with the load movably supported on the rails. The improvements relate to the configuration of the shoe and to a pair of reinforced spaced anchoring pins which allow engagement with one or the other pin by the lugs on the shoe by merely reversing, or rotating 180°, the position of the shoe on the rails. In one position of the shoe with its lugs engaged with one of the pins, retraction of the actuator will produce movement of the load in one direction. In the reversed position of the shoe with its lugs engaged with the other of the pins, extension of the actuator will produce movement of the load in the opposite direction.

11 Claims, 3 Drawing Sheets

APPARATUS FOR BI-DIRECTIONALLY MOVING AND PLACING LARGE AND HEAVY OBJECTS

BACKGROUND OF THE INVENTION

The present invention generally relates to moving and placing large and heavy objects and, more particular, is concerned with an improved apparatus for moving such objects bi-directionally to more precisely place them in a final position.

U.S. Pat. No. 3,659,823, Griffin, assigned to G & L Corporation of Fort Wayne, IN also the assignee of the present invention, discloses a portable apparatus for moving heavy objects with precision. Such objects, for example, large transformers, machines and the like, may weight several hundred tons and can be extremely large and bulky. The objects must be moved carefully and with precision especially to place them where desired during installation. Lack of prior control over their movement can require time-consuming adjustments and may result in damage to both the objects being moved and their surroundings.

For the most part, the overall performance of the portable apparatus of the above-cited patent in moving such large and heavy objects has met and even surpassed expectations over the years. However, from time to time, with any apparatus and the patented apparatus is not exception, a need for improvement arises to solve a problem which was not anticipated in the original design in order to increase performance and productivity even further.

One problem associated with the patented portable apparatus is that it can be only move the large object in one direction. This problem is inherent in the construction of the apparatus. To explain, in order for the apparatus to move the object, pins in pairs are laterally aligned and longitudinally spaced and secured along a pair of load support rails The pins are engaged by lugs on an actuator-supporting shoe. After the lugs of the shoe are engaged about a pair of pins, an actuator in the form of a hydraulic cylinder interconnecting the actuator-supporting shoe and another shoe supporting the load on the rails is actuated to retract and pull the heavy load along the rails The load is advanced or moved in a stepwise fashion along the rails. At the conclusion of each step of movement, the hydraulic cylinder is actuated to extend, advancing the actuator-supporting shoe away from the stationary load and bringing the shoe lugs into hooked engagement about the next pair of pins.

The feature in the construction of the apparatus which limits movement of the load to one direction is the location of a reinforcing bar with each pin of the respective pairs thereof extending from one side of the pin. The location of the bar only allows the actuator-supporting shoe lugs to hook the pins from the sides of the pins opposite from the reinforcing bars. As a result, the hydraulic cylinder can only pull or move the load in one direction. Should the apparatus accidentally move the object past the point where it should be stopped, the apparatus is not adapted to readily change or reverse direction and move the object to the desired position. Instead, it is necessary to lift the object or load with a crane, turn the entire apparatus around, replace the load and then move it into position in the opposite direction. As can be appreciated, this is usually quite time-consuming.

Consequently, a need exists for an improvement which will overcome this problem and thereby further enhance the utility and productivity of the portable moving device.

The present invention provides an improved large and heavy object moving apparatus designed to satisfy the aforementioned need. In place of the single pin located at one end of each reinforcing bar in the prior design, a pair of pins are located at the respective opposite ends of each reinforcing bar in the improved design This "double" pin arrangement allows engagement of one or the other pin by the lugs on the actuator-supporting shoe by merely reversing, or rotating 180° , the position of the shoe on the rails. In one position of the shoe with its lugs engaged with one of the pins in the pairs thereof, retraction of the hydraulic cylinder will produce movement of the load in a direction opposite from that produced in the reversed position of the shoe with its lugs engaged with the other of the pins in the pairs thereof. It can be readily appreciated that the time now required to correct for overshooting the desired position of the object is substantially shorter than before.

Accordingly, the present invention is directed to an improved portable apparatus for moving and precisely placing a large and heavy object. As in the original apparatus, the improved apparatus includes a pair of laterally spaced load support rails, a plurality of laterally aligned pairs of anchoring structures secured to and spaced longitudinally from one another along the rails, an actuator-supporting shoe movable along the support rails, a pair of elements attached to the shoe for releasable engaging one pair of the anchoring structures to hold the shoe in a stationary position, and an actuator extending between and connecting the shoe with the load movably support on the rails. The actuator is operable in a first mode for moving the load in one direction relative to the shoe when the elements are engaged with one pair of the anchoring structures and in a second mode for moving the shoe relative to the stationary load to disengage the elements from the one pair of anchoring structures and reset the elements in engagement with a next pair of the anchoring structures in preparation for the next movement of the load.

The improvements of the present invention incorporated by the apparatus relate to the constructions of the anchoring structures and the actuator-supporting shoe. Each of the anchoring structures in the plurality of pairs thereof is in the form of a reinforcing member attached to each of the rails and a pair of anchoring pins located at respective opposite ends of the reinforcing members and secured thereto The actuator-supporting shoe is configured for placement in a first orientation on the rails wherein elements on the shoe are aligned to releasably engage one of the pins or alternatively in a second orientation wherein the elements on the shoe are aligned to releasably engage the opposite other of the pins such that operation of the actuator in its first mode will produce movement of the load in one direction when the shoe is placed in its first orientation and in an opposite direction when the shoe is placed in its second orientation. The second orientation of the shoe is 180° reversed from its first orientation.

Further, the anchoring pins in each pair thereof are aligned in a generally horizontal plane. The reinforcing member is an elongated bar extending in the horizontal plane between the pins. The pins are also received and attached in holes formed in the respective rails.

These and other features and advantages of the present invention will become apparent to those skilled in the art upon a reading of the following detailed wherein there is shown and described an illustrative embodiment of the invention.

BRIEF DESCRIPTION OF THE DRAWINGS

In the course of the following detailed description, reference will be made to the attached drawings, in which.

DETAILED DESCRIPTION OF THE INVENTION

Figure 1:
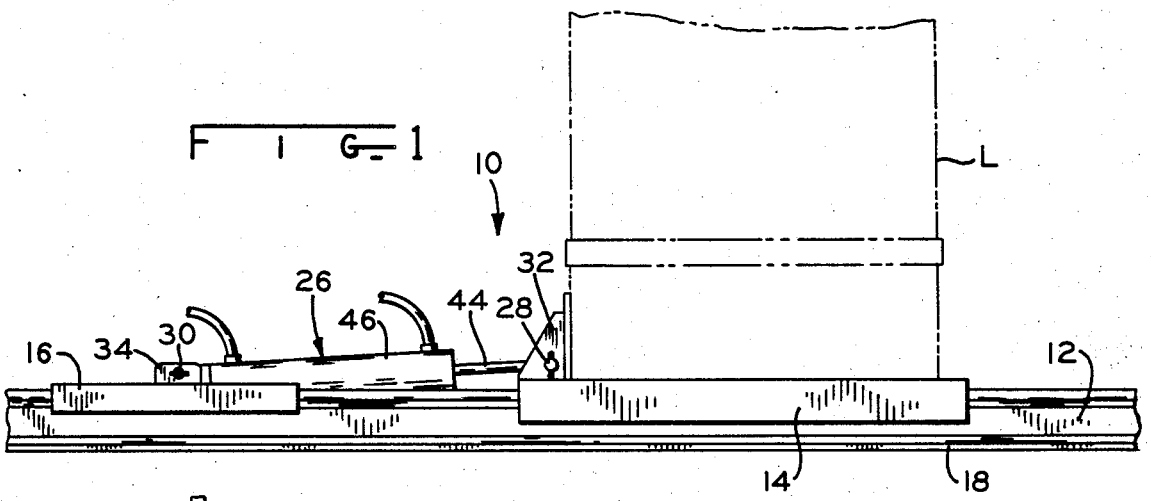
FIG. 1 is a fragmentary side elevational view of the moving apparatus employing the improvement of the present invention, illustrating in dashed line form a load on the apparatus.
Figure 2:
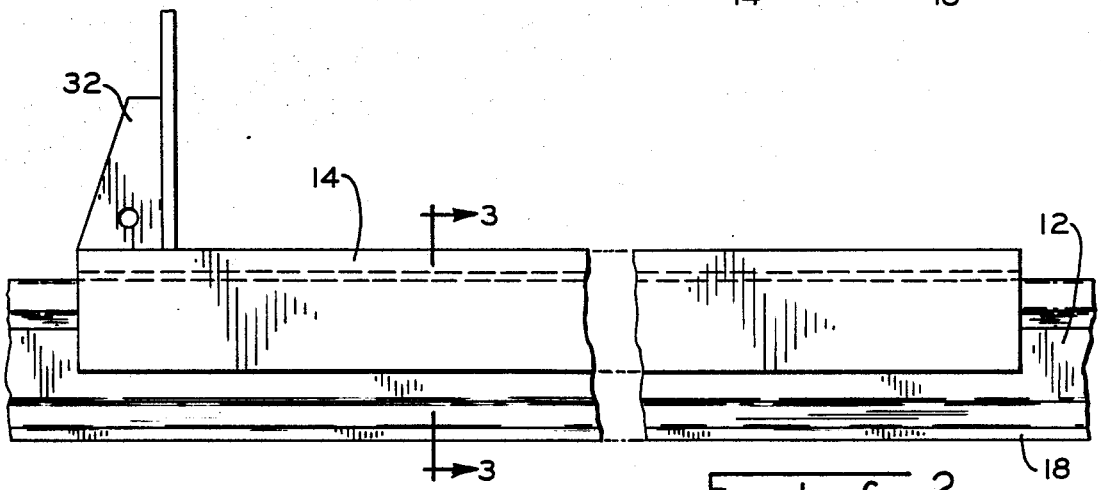
FIG. 2 is an enlarged side elevational view of a load-supporting shoe and portions of the load support rails of the apparatus of FIG. 1.
Figure 3:
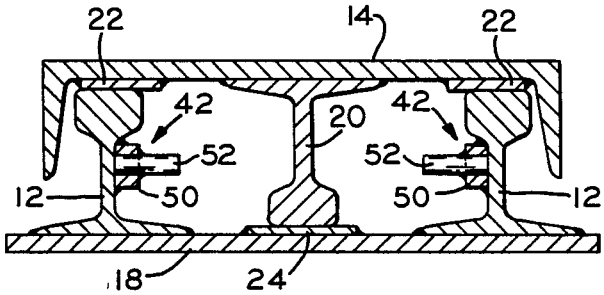
FIG. 3 is a cross-sectional view of the apparatus taken along line 3—3 of FIG. 2.

Referring now to the drawings, and particularly to FIGS. 1–5, there is shown an improved large and heavy object moving apparatus, generally designated by the numeral 10, incorporating the improvements of the present invention. Also, the improved apparatus 10 includes many of the same components of the prior art apparatus of U.S. Pat. No. 3,659,823. Only those of the prior components utilized in the improved apparatus 10 which are necessary for understanding the improvements of the present invention will be described below. A more complete understanding of the detailed construction of the prior components can be gained by referring to the cited patent, the disclosure of which is incorporated herein by reference.

As in the case of the prior art apparatus of U.S. Pat. No. 3,659,823, the improved apparatus 10 basically includes a pair of laterally spaced elongated load support rails 12, and a load-supporting shoe 14 and an actuator-supporting shoe 16, both shoes being mounted for sliding movement along the support rails 12. The support rails 12 are attached upright on a plate-like frame 18. The shoes 14, 16 are channel-like in cross-section and fit over the rails 12, as seen with reference to the load-supporting shoe 14 in FIG. 3. Their channel-like configurations guides and retains them on the rails 12 when they are slidably moved therealong. The shoes 14, 16 each have a middle rail 20 attached to and depending from their undersides and slidably engaging the middle of the frame 18 between the rails 12. Wear pad or strips 22, 24 are attached on the respective shoes 14, 16 and the frame 18 for reducing wear between the relative sliding components.

Also, like the prior apparatus, the improved apparatus 10 includes an actuator 26 in the form of an extendable and retractable hydraulic cylinder, as shown in FIGS. 1 and 8–10. The actuator 26 extends between and is connected by pivot pins 28, 30 to respective pairs of brackets 32, 34 fixed on the load-supporting shoe 14 and the actuator-supporting shoe 16. In such manner, the actuator 26 interconnects the actuator-supporting shoe 16 with the load movably supported on the rails.

Figure 9:
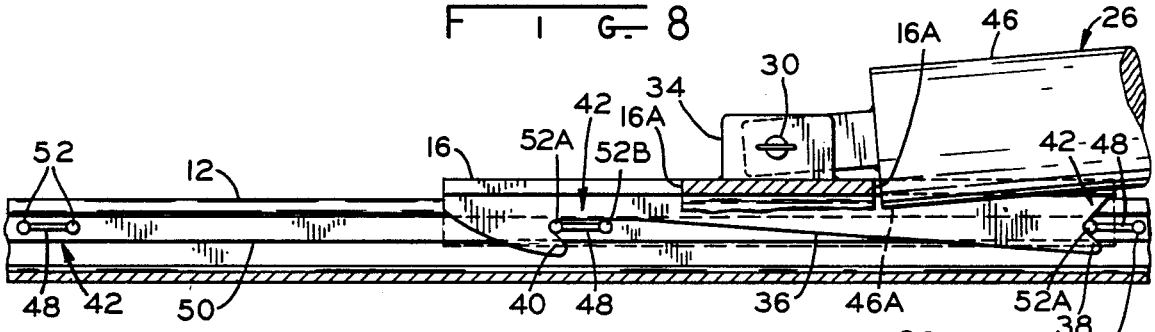
FIGS. 9 and 10 are enlarged fragmentary side elevational views of the apparatus of FIG. 1, illustrating respectively in FIG. 9 the position in which retraction of the hydraulic cylinder pulls the load to the left and in FIG. 10 the position in which the extension of the hydraulic cylinder pushes the load to the right.
Figure 10:
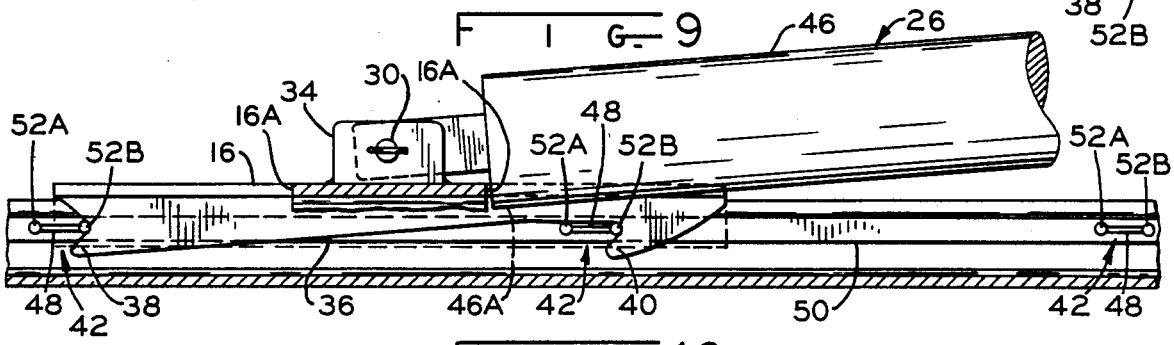

Further, as provided in the prior apparatus and as shown in FIGS. 9 and 10, the actuator-supporting shoe 16 of the improved apparatus 10 includes a pair of elongated members 36 on its underside which each define a pair of fore and aft spaced lugs 38, 40. The lugs 38, 40 have hook-like configurations adapting them to engage about features of pairs of anchoring structures, generally designated 42 in FIGS. 3–7, 9 and 10, secured on the facing sides of the rails 12 and constructed in accordance with the improvement of the present invention to be described below. The actuator 26 of the improved apparatus is operable in a first mode for moving the actuator-supporting shoe 14 and thus the load thereon in one direction along the rails 12 relative to the actuator-supporting shoe 16 when the lugs 38, 40 of the latter are engaged with one pair of the anchoring structures 42 and in a second mode for moving the actuator-supporting shoe 16 relative to the stationary load-supporting shoe 14 and load to disengage the lugs 38, 40 from the one pair of anchoring structures 42 and reset the lugs 38, 40 in engagement with a next succeeding pair of the anchoring structures 42 in preparation for the next movement of the load. In the embodiment illustrated, in its first mode of operation, a piston rod 44 of the actuator 26 retracts into its cylinder 46, pulling the load. In its second mode of operation, the piston rod 44 extends from the cylinder 46.

Figure 4:
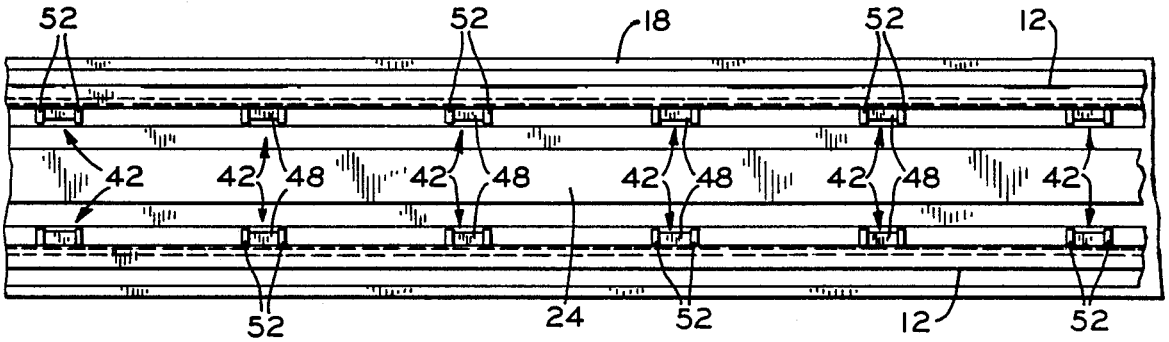
FIG. 4 is a fragmentary top plan view of the load support rails of the apparatus of FIG. 2, with the load-supporting shoe removed and illustrating also the paris of pins located at the opposite ends of each reinforcing member (the double pin and reinforcing bar arrangement) in accordance with the improvement of the present invention.
Figure 5:
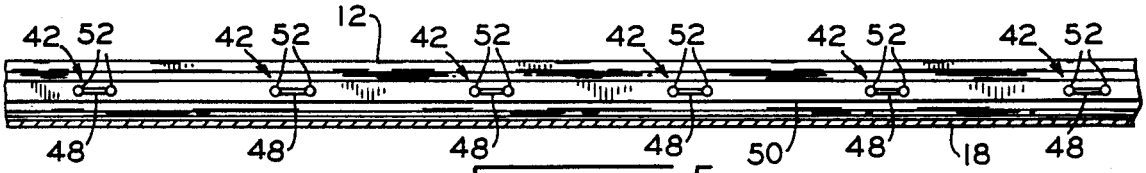
FIG. 5 is a side elevational view of one of the load support rails of the apparatus.
Figure 6:
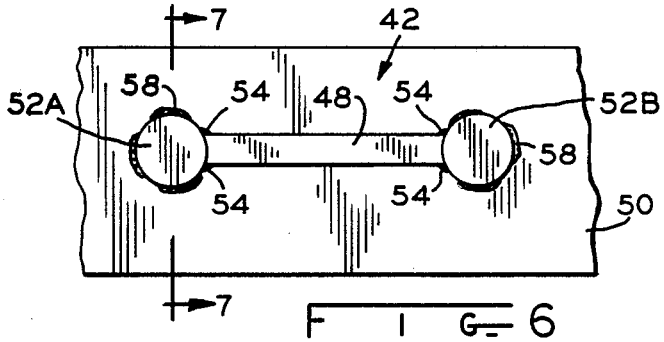
FIG. 6 is an enlarged view of a fragmentary portion of the rail of FIG. 5, illustrating the double pin and reinforcing bar arrangement of the present invention.
Figure 7:
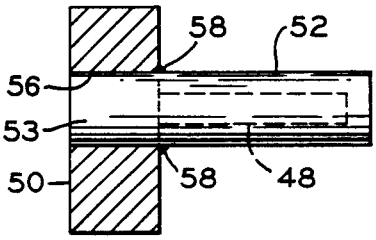
FIG. 7 is an enlarged sectional view of one of the pins of the arrangement taken along line 7—7 of FIG. 6, illustrating its attachment to the load support rail.
Figure 8:
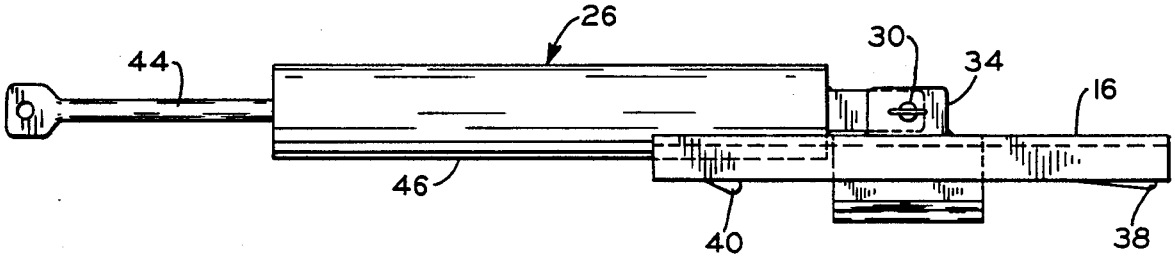
FIG. 8 is an enlarged side elevational view of the hydraulic cylinder and actuator-supporting shoe of the apparatus of FIG. 1, after removal of the same from the apparatus and as viewed from the side of the apparatus opposite from the side seen in FIG. 1.

The improvements of the present invention incorporated by the improved moving apparatus 10 relate to the constructions of the anchoring structures 42 and the actuator-supporting shoe 16. As seen in FIG. 4, the anchoring structures 42 are arranged in laterally aligned pairs secured to and spaced longitudinally from one another along the rails 12 and projecting toward one another from facing sides of the rails. Referring also to FIGS. 5–7, each of the anchoring structures 42 includes a reinforcing member 48 in the form of an elongated bar or gusset attached to a bar 50 of each rail 12 and a pair of elongated anchoring pins 52 spaced fore and aft apart and located at respective opposite ends of the reinforcing member 48. The pins 52 are secured, such as by welds 54, to the opposite ends of the reinforcing member 48. For further stabilizing the anchoring pins 52, as shown best in FIGS. 6 and 7, the pins 52 at their outer end portions 53 are inserted in holes 56 formed in the rail bar 50 and secured therein by welds 58. The pins 52 and reinforcing member 48 are aligned in a generally horizontal plane.

Figure 11:
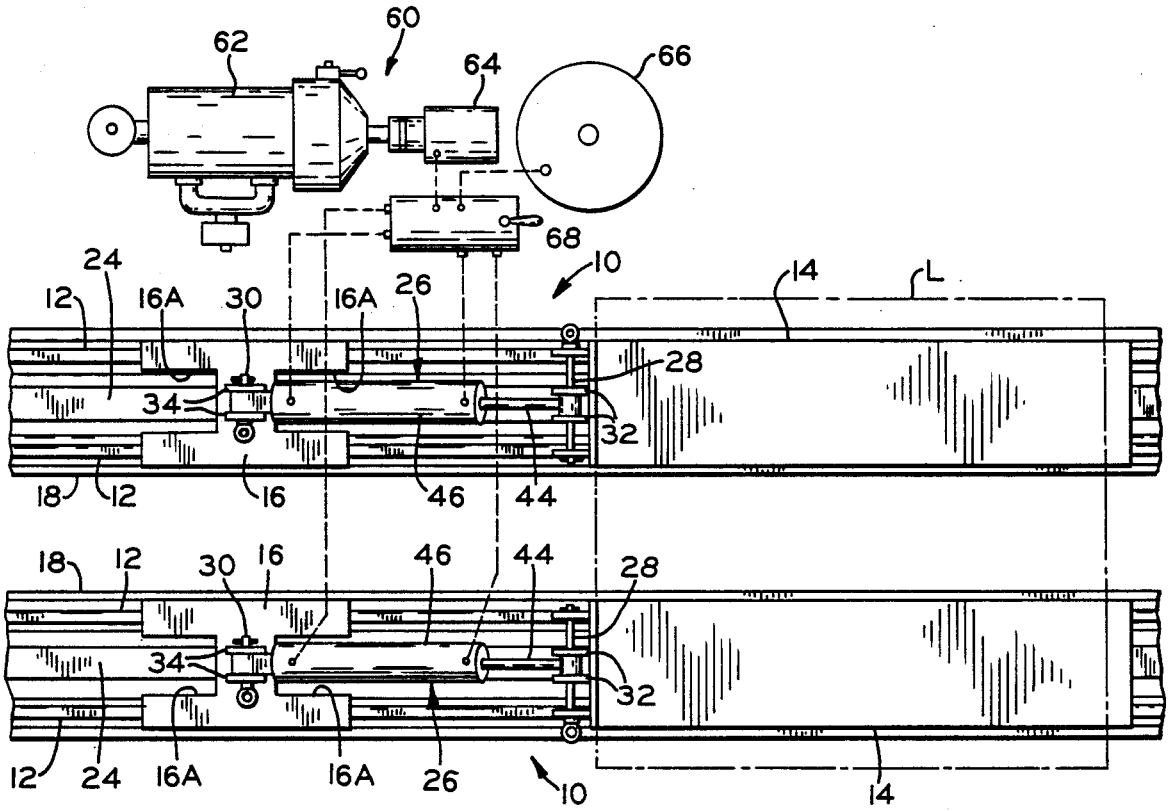
FIG. 11 is a top plan view of the apparatus in use, the fluid source, compressor and controls being illustrated schematically.

The other improvement relates to the configuration of the actuator-supporting shoe 16. As best seen in FIG. 11, the shoe 16 has an H-shaped configuration in plan view, defined by opposite recesses 16A. The recesses 16A accommodate the lower rear edge 46A of the actuator cylinder 46 for permitting placement of the shoe 16 in a first orientation on the rails 12 seen in FIG. 9 or alternatively in a second orientation on the rails 12 as seen in FIG. 10. In its second orientation of FIG. 10, the shoe is 180° reversed from its first orientation. The presence of the pair of pins 52 and the capability of reversing the orientation of the shoe 16 makes it possible to push and pull the load in both directions, merely by reversing the position of the shoe 16. This is done by removing the pivot pin 30 to disconnect the actuator 26 from the shoe 16, then reversing the shoe 16, and finally reinserting the pin 30 to reconnect the actuator 26 to the shoe 16.

When the actuator-supporting shoe 16 is positioned in its first orientation of FIG. 9, the lugs 38, 40 thereon are aligned to releasably engage the left ones 52A of the pins 52 whereupon operation of the actuator 26 in its first (retractive) mode will produce movement of the load to the left. Alternatively, when the shoe 16 is positioned in its second, or reverse, orientation of FIG. 10, the lugs 38, 40 thereon are aligned to releasably engage the opposite, right ones 52B of the pins 52 such that operation of the actuator 26 again in its second (extending) mode will produce movement of the load in the opposite direction toward the right.

Referring to FIG. 11, in operation two of the improved apparati 10 are positioned side by side to move a large load. A power unit 60 is provided with an engine 62, a pump 64, a fluid reservoir 66 and a control unit 68 mounted on a common base. The power unit 60 can be moved from location to location as can each improved apparatus 10.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed is:

1. A portable apparatus for moving and precisely placing a large and heavy object, said apparatus comprising: a pair of load support rails, a load supporting means disposed on said rails, a plurality of pairs of anchoring structures secured to and spaced longitudinally from one another along said rails, an actuator-supporting shoe movable along said support rails, a pair of elements attached to said shoe for releasably engaging one pair of said anchoring structures to hold said shoe in a stationary position, and an actuator means extending between and connecting said shoe with said load supporting means movably supported on said rails, said actuator means being operable in a first mode for moving the load supporting means in one direction relative to said shoe when said elements are engaged with one pair of said anchoring structures and in a second mode for moving said shoe relative to the stationary load supporting means to disengage said elements from said one pair of said anchoring structures and reset said elements in engagement with a next pair of said anchoring structures in preparation for the next movement of the load supporting means, each of said anchoring structures in said plurality of pairs thereof comprising a pair of reinforced spaced-apart anchoring pins secured to each rail, each said pair of pins comprising a first pin having a side facing in a first direction and a second pin having a side facing in a second direction 180° opposite to said first direction, said shoe being configured for placement on said rails in a first orientation wherein said elements thereon are aligned to releaseably engage said first direction-facing side of one of said first pins or alternatively in a second orientation disposed 180° to the first orientation wherein said elements thereon are aligned to releasably engage with second direction-facing side of one of said second pins such that operation of said actuator in one of its modes will produce movement of the load supporting means in one direction when said shoe is placed in said first orientation and in an opposite direction when said shoe is placed in said second orientation.

2. The apparatus as recited in claim 1, wherein said pins are received and attached in holes formed in said respective rails.

3. The apparatus as recited in claim 1, wherein said anchoring pins in each pair thereof are aligned in a generally horizontal plane.

4. The apparatus as recited in claim 1 further comprising: a reinforcing member disposed between said pins of each pair such that said pins re located at respective opposite ends of said reinforcing member and secured thereto.

5. The apparatus as recited in claim 4, wherein said anchoring pins in each pair thereof are aligned in a generally horizontal plane.

6. The apparatus as recited in claim 5, wherein said reinforcing member is an elongated bar extending in the horizontal plane between said pins.

7. The apparatus as recited in claim 6, wherein said pins are received and attached in holes formed in said respective rails.

8. A portable apparatus for moving and precisely placing a large and heavy object, said apparatus including a pair of load support rails, a load supporting means disposed on said rails, a plurality of pairs of anchoring structures secured to and spaced longitudinally from one another along said rails, an actuator-supporting shoe movable along said support rails, a pair of lugs attached to said shoe for releasably engaging one pair of said anchoring structures to hold said shoe in a stationary position, and an actuator extending between and connecting said shoe with said load supporting means movably supported on said rails, said actuator being operable in a first mode for moving the load supporting means in one direction relative to said shoe when said lugs are engaged with one pair of said anchoring structures and in a second mode for moving said shoe relative to the stationary load supporting means to disengage said lugs from said one pair of said anchoring structures and reset said lugs in engagement with a next pair of said anchoring structures in preparation for the next movement of the load supporting means, wherein the improvement comprises:

each of said anchoring structures in said plurality of pairs thereof comprising a pair of reinforced spaced-apart anchoring pins secured to each rail and aligned in a generally horizontal plane, and a reinforcing member secured to each rail and disposed between said pins such that said pins are located at respective opposite ends of said reinforcing member and secured thereto; and said shoe being configured for placement on said rails in a first orientation wherein said lugs thereon are aligned to releasably engage one of said pins or alternatively in a second orientation wherein said lugs thereon are aligned to releasably engage the opposite other of said pins such that operation of said actuator in one of its modes will produce movement of the load supporting means in one direction when said shoe is placed in said first orientation and in an opposite direction when said shoe is placed in said second orientation.

9. The apparatus as recited in claim 8, wherein said second orientation of said actuator-supporting shoe is 180° from said first orientation thereof.

10. The apparatus as recited in claim 8, wherein said pins are also received and attached in holes formed in said respective rails.

11. The apparatus as recited in claim 8, wherein said reinforcing member is an elongated bar extending in the horizontal plane between said pins.

* * * * *